US010468210B2

(12) United States Patent
Müller

(10) Patent No.: US 10,468,210 B2
(45) Date of Patent: Nov. 5, 2019

(54) KEY TAPPET FOR A KEY MODULE OF A KEY FOR A KEYBOARD, KEY MODULE OF A KEY FOR A KEYBOARD AND METHOD FOR PRODUCING IT

(71) Applicant: ZF Friedrichshafen AG, Friedrichshafen (DE)

(72) Inventor: Karl-Heinz Müller, Auerbach (DE)

(73) Assignee: CHERRY GMBH, Auerbach/OPF (DE)

( * ) Notice: Subject to any disclaimer, the term of this patent is extended or adjusted under 35 U.S.C. 154(b) by 0 days.

(21) Appl. No.: 14/894,875

(22) PCT Filed: May 5, 2014

(86) PCT No.: PCT/EP2014/059042
§ 371 (c)(1),
(2) Date: Nov. 30, 2015

(87) PCT Pub. No.: WO2014/195069
PCT Pub. Date: Dec. 11, 2014

(65) Prior Publication Data

US 2016/0133403 A1 May 12, 2016

(30) Foreign Application Priority Data

Jun. 7, 2013 (DE) ..... 10 2013 210 609

(51) Int. Cl.
*H01H 13/14* (2006.01)
*H01H 13/20* (2006.01)
(Continued)

(52) U.S. Cl.
CPC ..... *H01H 13/14* (2013.01); *H01H 11/00* (2013.01); *H01H 13/04* (2013.01); *H01H 13/20* (2013.01);
(Continued)

(58) Field of Classification Search
CPC ..... H01H 13/14; H01H 11/00; H01H 13/04
(Continued)

(56) References Cited

U.S. PATENT DOCUMENTS 3,773,997 A * 11/1973 Evans ..... B41J 5/12 200/330

FOREIGN PATENT DOCUMENTS

DE 2209620 A 9/1972
DE 9113199 U1 11/1992
(Continued)

OTHER PUBLICATIONS

International Search Report dated Jul. 29, 2014 in International Application No. PCT/EP2014/059042 (English language, 2 pages).
(Continued)

*Primary Examiner* — Kyung S Lee
*Assistant Examiner* — Iman Malakooti
(74) *Attorney, Agent, or Firm* — James R Hayne; Stites & Harbison, PLLC

(57) ABSTRACT

The invention proposes a key tappet for a key module of a key for a keyboard. The key tappet comprises a coupling section for coupling a key button and a guiding section for guiding the key tappet in a receiving section of the key module upon actuation of the key tappet. The guiding section has at least one sliding section to slide in the receiving section of the key module during the actuation of the key tappet. Demolding fins caused by demolding of the key tappet are arranged outside the at least one sliding section.

10 Claims, 3 Drawing Sheets

(51) Int. Cl.

| | |
|---|---|
| ***H01H 11/00*** | (2006.01) |
| ***H01H 13/04*** | (2006.01) |
| *H01H 13/50* | (2006.01) |
| *H01H 13/704* | (2006.01) |
| *H01H 13/705* | (2006.01) |

(52) U.S. Cl.
CPC ..... *H01H 13/50* (2013.01); *H01H 13/704* (2013.01); *H01H 13/705* (2013.01); *H01H 2229/044* (2013.01); *H01H 2237/006* (2013.01)

(58) Field of Classification Search
USPC ..... 200/345
See application file for complete search history.

(56) References Cited

FOREIGN PATENT DOCUMENTS

| | | |
|---|---|---|
| EP | 1557853 A1 | 7/2005 |
| FR | 2169812 A1 | 9/1973 |

OTHER PUBLICATIONS

International Search Report and Written Opinion dated Jul. 29, 2014 for PCT/EP2014/059042 (German language, 9 pages).
German Office Action dated Dec. 13, 2013 for DE 10 2013 210 609.2, (German language, 5 pages).
Translation of p. 5 of German Search Report Mar. 20, 2014 for DE 10 2013 212 398.1 (2 pages).

* cited by examiner

KEY TAPPET FOR A KEY MODULE OF A KEY FOR A KEYBOARD, KEY MODULE OF A KEY FOR A KEYBOARD AND METHOD FOR PRODUCING IT

RELATED APPLICATIONS

This application is a filing under 35 U.S.C. § 371 of International Patent Application PCT/EP2014/059042, filed May 5, 2014, and claims the priority of German Patent Application DE 10 2013 210 609.2, filed Jun. 7, 2013, both of which are incorporated by reference herein in their entirety.

BACKGROUND

1. Technical Field

The present invention relates to a key tappet for a key module of a key for a keyboard, to a key module for a keyboard and to a method for manufacturing a key module for a key for a keyboard.

2. Background Information

In keyboards for example for computers or similar devices are usually used key switches with a base, contact piece, contact transmitter, etc. for the individual keys. An example of a key switch is disclosed in DE 37 13 775 C2, which in particular describe an adjustment of a pressure point of a MX module.

BRIEF SUMMARY OF THE INVENTION

Against this background, the present invention provides an improved key tappet for a key module of a key for a keyboard, an improved key module of a key for a keyboard and an improved method for manufacturing a key module for a key for a keyboard, according to the independent claims. Advantageous embodiments result from the dependent claims and the following description.

According to the embodiments of the present invention, a key tappet for a key module of a key for a keyboard can in particular be configured such that the key tappet has no demolding fins on the sliding surfaces for sliding in the key module. In particular, a key module, especially MX module, can be provided with a key tappet with advantageous and improved sliding properties. The key tappet can for example have particularly smooth sliding surfaces or sliding surfaces with minimized surface roughness. Thus, a key module, in particular an MX module, can be provided with a key tappet specially adapted for improved sliding properties.

According to the embodiments of the present invention, using such a key tappet with sliding surfaces with a reduced surface roughness, in particular a key module with a minimized friction upon actuation can be advantageously provided. When actuating and when shifting the key back, it can be achieved here that due to the improved key tappet with minimized-friction sliding surfaces a user is mediated a positive actuation feeling and high operating speeds are possible. Especially advantageous is the avoidance of scratching and hooking operation feeling by eliminating demolding fins in the area of the sliding surfaces or guide surfaces of the key tappet.

Apart from the key tappet, standard parts can continue to be used for the key module. The key tappet can for example be installed in a standard MX module. Here, conveniently only particular modifications on the guiding section or the sliding section of the key tappet must be made, whereas the remaining parts of the key module may be standard parts. Thus, the use of an existing model of a key module is possible with only minor modifications of the key tappet. Thus also a standard module assembly, in particular a standard MX module assembly, for example, a printed circuit board assembly or frame assembly can be performed. Further, only a minor change in the key tappet guiding must be made in the production facilities, in particular in the MX manufacturing machine, to manufacture the key module tappet with the improved key. Other standard features of the key module, such as an MX module, remain advantageously unchanged.

In addition, the key tappet can be accommodated so they can slide in a receiving section of a module housing of the key module. This results in a reduction in the guide play during the operation due to an advantageous reduction of tolerances. Due to minimized tolerances between the key tappet, the receiving section and a switching point, a high switching accuracy, short shifting paths, a quickly reached switching point, a short total distance, rapid switching back and a minimized tendency of the key for tilting and twisting result. In addition, the key tappet can be formed along an axis of actuation with an appropriate length dimension to enable a short total path and a quick switching back. With such a key tappet, the key operation feeling for a user is improved, upon actuation of the key the switching point is achieved faster and the total path is also reduced.

A particularly advantageous key tappet for a key module of a key for a keyboard includes a coupling section for coupling a key button of the key and a guiding section for guiding the key tappet in a receiving section of the key module upon actuation of the key tappet and is characterized in that the guiding section has at least one sliding section for sliding in the receiving section of the key module upon actuation of the key tappet, wherein the demolding fins of the key tappet caused by demolding of the key tappet are arranged outside the at least one sliding section.

A keyboard can comprise at least one key, wherein one key module is provided per key. A key can comprise the key module or be formed by the key module. The key module may be, for example, a so-called MX module or the like. By using or installing the aforementioned key module in a keyboard, upon actuation of the key, friction between the tappet and the key receiving section can be minimized. The key button may represent a part of the key module visible for an operator and be operated by depressing. The coupling section of the key tappet can be mechanically coupled with the key button. In an assembled state of the key module, the guiding section of the key tappet can be at least partially movably received in the receiving section of the key module along an actuation axis or longitudinal axis of extension of the key tappet. The guiding section may be designed to guide upon actuation the key tappet in the receiving section in a linear path within a tolerance range. The at least one sliding section may have a substantially planar surface of the key tappet in the guiding section. Here, the at least one sliding section may be formed to contact a surface of the receiving section of the key module and to be slidable along the receiving section.

According to one embodiment, the guiding section may have at least one rounded edge, which is arranged in a region of the at least one sliding section. Such an embodiment offers the advantage that by such edge rounding the key tappet has improved sliding properties upon actuation movement in the key module.

Also, the guiding section may be surface-treated in the at least one sliding surface to minimize surface roughness. In this case, at least one surface of the guiding section in the at least one sliding section can be polished or the like. In particular, the guiding section can comprise a surface-finished plastic material at least in a section, for example, solely or inter alia, a polyoxymethylene (POM) with surface refinement. Such an embodiment offers the advantage that with a key tappet, an improvement of the sliding properties relative to the key module and a reduction in surface roughness can be achieved. This advantage can also be essentially achieved regardless of the material used for the guiding section. In addition, for example, a standard material normally used for the key tappets or their guiding section can be used with subsequent surface finishing.

In addition, the guiding section can also be formed from a friction-minimizing plastic material or from a plastic material with a friction-minimizing additive. Here, the friction-minimizing plastic material or the plastic material with the friction-minimizing additive has a particularly low surface roughness. The additive can cause improved sliding properties, and the additive can in particular be free of oil or grease. Such an embodiment offers the advantage that a key tappet can be realized with improved sliding properties and an improved surface roughness of the guiding section. A friction-minimizing property of the guiding section can be taken into account already in the initial material.

In particular, the at least one sliding section can extend along an axis of actuation of the key tappet over at least two-thirds of a dimension of the guiding section along the actuation axis. Such an embodiment offers the advantage that such a length dimension of the at least one guiding section can result in a high guiding accuracy and a low guiding play of the key tappet in the receiving section of the key module.

A particularly advantageous key module of a key for a keyboard has a module housing with a receiving section for receiving a key tappet and is characterized in that the key module has the form of the above-mentioned key tappet, wherein the guiding section of the key tappet is receivable or received in the receiving section of the key module.

In conjunction with the key module, a version or variant of the above-described key tappet can be advantageously used to effect an improvement in the sliding properties of the key tappet in the key module.

According to an embodiment, a dimension of the at least one sliding section along an axis of actuation of the key tappet and a dimension of the receiving section along the axis of actuation can be so matched to one another that upon actuation of the key tappet between a rest position and an actuating position with respect to the module housing, the at least one sliding section of the key tappet is arranged mainly inside the receiving section of the module housing. Upon actuation, the at least one sliding section can be arranged along at least one half of its dimension, with respect to the axis of actuation, adjacent to the receiving section. The rest position of the key tappet or the key module or the key can correspond to a non-loaded or non-depressed state of the key. The actuation position of the key tappet or the key module or the key can correspond to a loaded or pressed state of the key. Such an embodiment offers the advantage that upon actuation, a high guiding accuracy and a low guiding play of the key tappet in the receiving section of the key module can be achieved.

A particularly advantageous method for manufacturing a key module of a key for a keyboard has the following steps:

Providing an embodiment of the above-mentioned key tappet and a module housing having a receiving section for receiving the key tappet; and Arranging the guiding section of the key tappet in the receiving section of the module housing so that upon actuation of the key tappet, the at least one sliding section of the guiding section of the key tappet is sliding in the receiving section of the module housing.

The process can advantageously be carried out in conjunction with a version or variant of the above-described key tappet or key modules. By carrying out the process, a version or variant of the above-described key module can be advantageously manufactured with improved gliding properties of the key tappet in the key module.

According to one embodiment, in the step of providing, the key tappet can be surface-treated in the at least one sliding section of the guiding section to minimize the surface roughness. In particular, the at least one sliding section can be polished or otherwise surface treated. Such an embodiment offers the advantage that the key tappet with such a surface-treated guiding section has particularly good sliding properties as regards the operation of the key tappet. Such a surface treatment is a favorable way to provide key tappets made, for example, of a commonly used material with improved sliding properties.

In the step of providing, at least the guiding section of the key tappet can also be formed from a friction-minimizing plastic material or from a plastic material with a friction-minimizing additive. Here, the friction-minimizing plastic material or the plastic material with the friction-minimizing additive can be suitably selected with regard to the formation of a sliding surface with a friction-minimizing property. Such an embodiment offers the advantage that by appropriate material selection the key tappet has particularly good sliding properties with respect to the operation of the key tappet. Here, either the subsequent surface treatment of the at least one sliding section can also be advantageously omitted to minimize the manufacturing costs, or an additional surface treatment of at least one sliding section can be carried out to still further improve the sliding properties.

BRIEF DESCRIPTION OF THE DRAWINGS

The invention is explained in more detail by way of example with reference to the accompanying drawings. The drawings show.

DETAILED DESCRIPTION OF THE DRAWINGS AND THE PRESENTLY PREFERRED EMBODIMENTS

Figure 1:
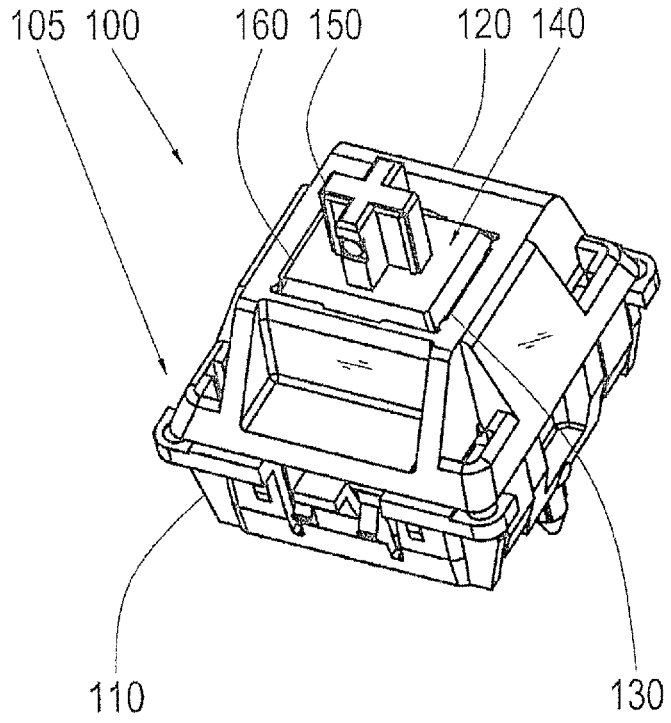
FIG. 1: A key module

In the following description of preferred embodiments of the present invention, the same or similar reference numerals are used for the similarly acting elements shown in the various figures, and a repeated description of these elements is omitted.

FIG. 1 shows a perspective view of a key module 100. The key module 100 includes a module housing 105 having a module connector 110, a module cover 120, a receiving section 130 and a key tappet 140 with a coupling section 150 and a guiding section 160. The key module 100 is, for example, part of a key for a keyboard. The key module 100 is, for example, the key module shown and described in FIGS. 3A and 3B or a similar key module. The key tappet 140 is, for example, the tappet key shown and described in FIGS. 2A and 2B or a similar key tappet.

The module base 110 and the module cover 120 are coupled together. Here, the base module 110 and the module cover 120 form the module housing 105 of the key module 100. The receiving section 130 of the key module 100 is formed as a shaft extending from the module cover 120 through at least one section of the module housing 105 of the key module 100.

The key tappet 140 is partially received in the receiving section 130. Here, the coupling section 150 of the key tappet 140 is at least partially arranged outside the module housing 105 of the key module 100. The coupling section 150 is formed to allow a coupling of a key button. The guiding section 160 of the key tappet 140 is in this case at least partially received in the receiving section 130 of the key module 100.

Upon actuation, the key tappet 140 is movable relative to the module housing 105 of the key module 100 formed by the module base 110 and the module cover 120. Although it is not explicitly recognizable in FIG. 1, an actuation axis of the key tappet 140, along which the key tappet 140 can be moved upon actuation, extends along a longitudinal axis of extension of the receiving section 130 of the key module 100.

Figure 2A:
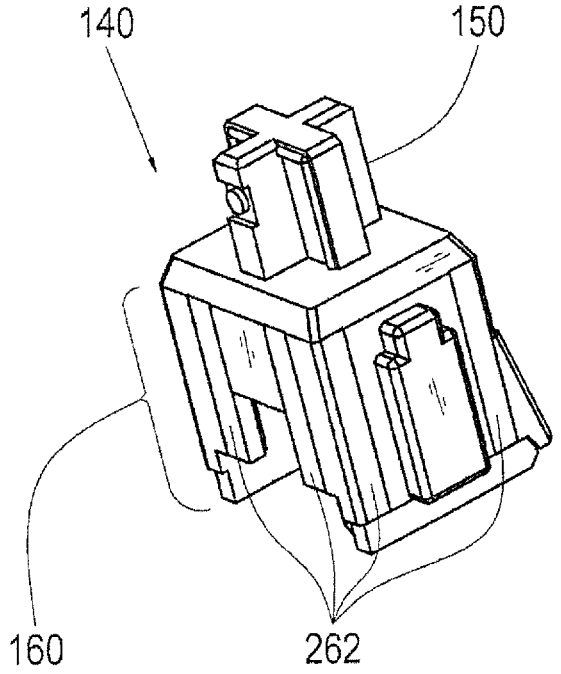
FIGS. 2A and 2B: A key tappet according to an embodiment of the present invention.

FIG. 2A shows a perspective view of a key tappet 140 according to an embodiment of the present invention for a key module of a key of a keyboard. The key tappet 140 has a coupling section 150, a guiding section 160 and a plurality of sliding sections 262 and sliding surfaces or guiding surfaces, of which four sliding sections 262 are shown in FIG. 2A merely as an example. The key tappet 140 is, for example, the key tappet of the key module in FIG. 1.

The key tappet 140 has a rectangular base area or base plane, from which the coupling section 150 extends in a first direction and the guiding section 160 extends in the second direction opposite to the first direction. The coupling section 150 has a cross-shaped horizontal section and is extruded from the base plane in the first direction. The guiding section 160 has a trough-shaped outer section extruded in the second direction and consisting of four side walls, and an inner section extruded cylindrically in the second direction, at least partially surrounded by the outer section. The inner section is concealed in the representation of FIG. 2A by the outer section, but is recognizable in the illustration of FIG. 2B.

The sliding sections 262 are arranged on the outer section of the guiding section 160. According to the embodiment of the present invention represented in FIG. 2A, the sliding sections 262 are formed as polished guiding surfaces. The sliding sections 262 are so formed as to enable upon actuation of the key tappet 140 a sliding friction-minimized relative movement between the key tappet and a key module. The guiding section 160 has a first end section, which is facing the coupling section and is adjacent with respect to the base surface. The guiding section 160 has also a second end section facing away from the coupling section 150 and the base surface. The sliding sections 262 extend from the first end section of the guiding section 160 on an outer side of the key tappet 140 to the second end section of the guiding section 160. For example, the sliding sections 262 extend in this case over at least two thirds of a dimension of the guiding section 160 between the first end section and the second end section.

Figure 2B:
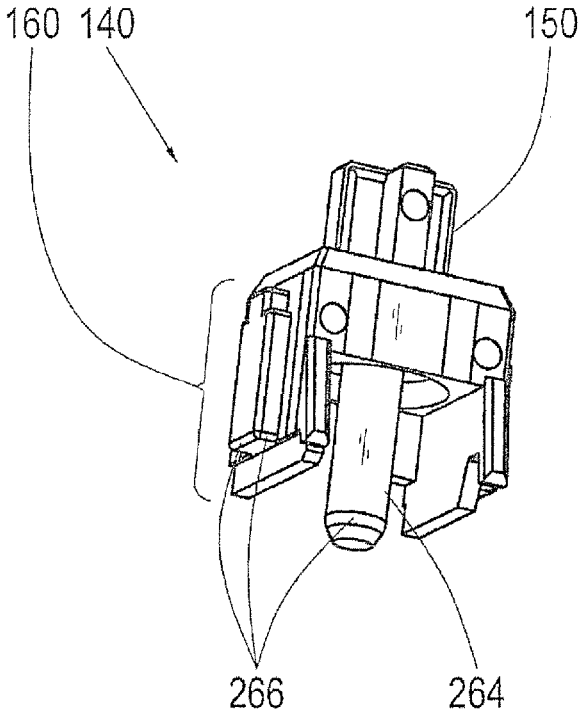

FIG. 2B shows another perspective view of the key tappet 140 of FIG. 2A. In this case, from the key tappet 140 are shown the coupling section 150, the guiding section 160, the cylindrically extruded inner section of the guiding section 160, at least partially surrounded by the outer section of the inner section of the guiding section 160 in the form of a pin 264, and rounded edges 266.

The pin 264 represents, for example, a further sliding section of the guiding section 160. The rounded edges 266 are arranged on the outer section of the guiding section 160 in the area of the sliding sections, in particular at least in the second end section of the guiding section 160. Further, the pin 264 comprises in the second end section of the guiding section 160 a rounded edge 266.

As can be seen in FIGS. 2A and 2B, the key tappet 140 or its guiding section 160 has no demolding fins in the area of the sliding sections 262.

Figure 3A:
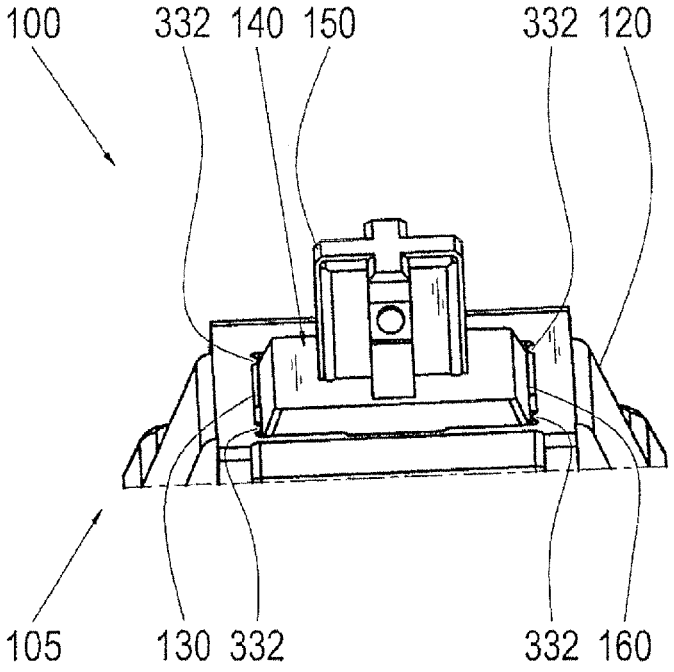
FIGS. 3A and 3B: A key module according to an embodiment of the present invention.

FIG. 3A shows a perspective view of a key module 100 according to an embodiment of the present invention in an oblique plan. The key module 100 is, for example, part of a key for a keyboard. From the key module 100 are shown in the diagram of FIG. 3A a module housing 105 with a module cover 120, as well as receiving section 130 and guiding elements 332 and a key tappet 140 with a coupling section 150 and a guiding section 160. The module housing 105 is the module housing 105 of FIG. 1 or a similar module housing. The key tappet 140 is the key tappet of FIG. 2A or FIG. 2B.

The receiving section 130 of the key module 100 is formed as a shaft extending from the module cover 120 through at least one section of the module housing 105 of the key module 100. The module cover 120 of the module housing 105 is, for example, coupled to a module base, even though this is not shown in FIG. 3A due to the type of illustration.

The key tappet 140 is partially received in the receiving section 130. Here, the coupling section 150 of the key tappet 140 is arranged at least partially outside the module housing 105 of the key module 100. The coupling section 150 is formed so as to allow a coupling of a key button. The guiding section 160 of the key tappet 140 is in this case at least partially received in the receiving section 130 of the key modules 100.

Upon actuation, the key tappet 140 is movable relative to the module housing 105 of the key module 100. Although it is not explicitly visible in FIG. 3A, an actuation axis of the key tappet 140, along which the key tappet 140 is movable upon actuation, extends along a longitudinal axis of extension of the receiving section 130 of the key module 100.

According to the embodiment of the present invention shown in FIG. 3A, a plurality (four in this case merely as an example) of the guiding elements 332 is arranged in the receiving section 130. The guiding elements 332 are formed as protrusions. In the key tappet 140 arranged in the receiving section 130, the guiding elements 332 in the receiving section 130 of the key tappet 140 are arranged, by way of example, in the area of the sliding sections of the outer section of the guiding section 160 of the key tappet 140. The sliding sections of the guiding section 160 of the key tappet 140 are in this case arranged adjacent to the guiding elements 332.

Figure 3B:
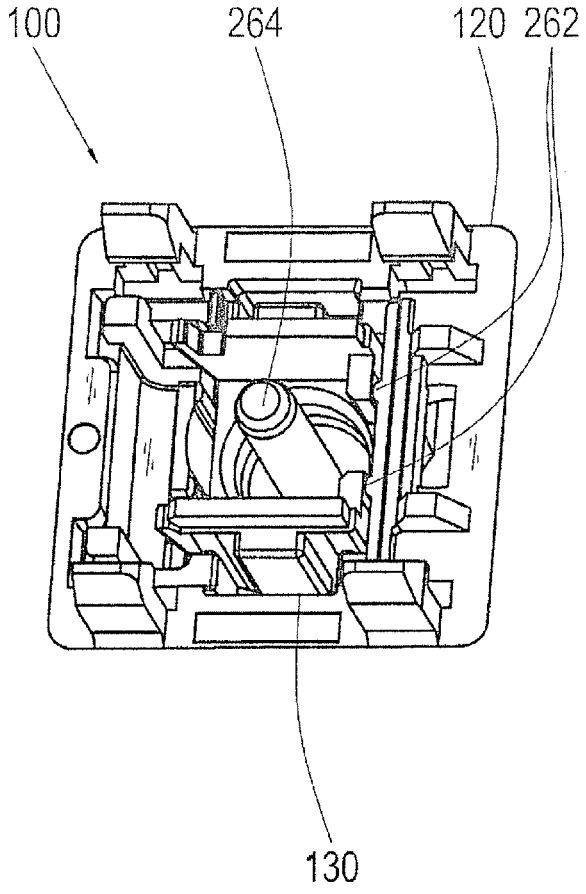

FIG. 3B shows a perspective view of the key module 100 of FIG. 3A in a view with the module bases removed. From the key module 100 are shown in FIG. 3B the module cover 120 of the module housing 120, the receiving section 130 and the sliding sections 262 as well as the pin 264 of the key tappet. The sliding sections 262 extend here from the first end section of the guiding section of the key tappet, for example, to the second end section of the guiding section of the key tappet.

Figure 4:
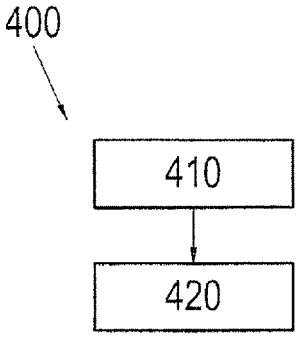
FIG. 4: A flow chart of a method according to an embodiment example of the present invention.

FIG. 4 shows a flow diagram of a method 400 for manufacturing a key module of a key for a keyboard according to an embodiment of the present invention. The method 400 comprises a step 410 of providing a key tappet and a module housing having a receiving section for receiving the key tappet. The key tappet is a key tappet like one of the key tappets shown in FIGS. 2A to 3B. The method 400 also includes a step 420 of disposing the guiding section of the key tappet in the receiving section of the module housing so that upon actuation of the key tappet, the at least one sliding section of the guiding section of the key tappet slides in the receiving section of the module housing. The implementation of the method 400 allows to advantageously manufacture a key module like one of the key modules from one of FIGS. 3A and 3B.

According to an embodiment, the key tappet is surface-treated in at least one sliding section of the guiding section in order to minimize surface roughness. According to an embodiment, in step 410 of providing, at least the guiding section of the key tappet is formed of a friction-minimizing plastic material or of a plastic material with a friction-minimizing additive.

The embodiments described and shown in the figures are chosen only by way of example. Different embodiments may be combined in whole or in terms of individual features. An embodiment can also be supplemented by features of another embodiment. Steps of the described methods can be performed repeatedly.

REFERENCE NUMERALS

100 Key module
105 Module housing
110 Module base
120 Module cover
130 Receiving section
140 Key tappet
150 Coupling section
160 Guiding section
262 Sliding section or guiding surface or sliding surface
264 Pin
266 Rounded edge
332 Guiding element
400 Method for manufacturing
410 Step of providing
420 Step of arranging

The invention claimed is:

1. A key tappet for a key module of a key for a keyboard comprising:

a base plane;

a coupling section for coupling a button of the key, the coupling section extending from the base plane;

a guiding section for guiding the key tappet in a receiving section of the key module upon actuation of the key tappet, the guiding section comprising at least one sliding section for sliding the key module in the receiving section upon actuation of the key tappet, the receiving section comprising a plurality of guide elements formed as protrusions, the guiding section having at least one rounded edge arranged in a region of the at least one sliding section, and wherein the at least one sliding section is arranged adjacent to at least one of the plurality of a guide elements; and demolding fins of the key tappet caused by demolding of the key tappet arranged outside the at least one sliding section, wherein the at least one sliding section extends along an axis of actuation of the key tappet over at least two thirds of a dimension of the guiding section along the actuation axis.

2. The key tappet of claim 1, wherein the guiding section is surface-treated in the at least one sliding section to minimize surface roughness.

3. The key tappet of claim 1, wherein the guiding section is formed of a friction-minimizing plastic material or of a plastic material with a friction-minimizing additive.

4. A key module of a key for a keyboard comprising:

a module housing comprising a receiving section for receiving a key tappet; and the key tappet comprising a coupling section for coupling a button of the key, a guiding section for guiding the key tappet in a receiving section of the key module upon actuation of the key tappet, the guiding section comprising at least one sliding section for sliding the key module in the receiving section upon actuation of the key tappet, and demolding fins arranged outside the at least one sliding section;

wherein the at least one sliding section extends along an axis of actuation of the key tappet over at least two thirds of a dimension of the guiding section along the actuation axis and wherein the guiding section has at least one rounded edge arranged in a region of the at least one sliding section.

5. The key module of claim 4, wherein a dimension of the at least one sliding section of the key tappet and a dimension of the receiving section are coordinated along the actuation axis so that upon actuation of the key tappet between a rest position and an actuating position with respect to the module housing, the at least one sliding section of the key tappet is largely arranged within the receiving section of the module housing.

6. The key tappet of claim 1, wherein the guiding section is surface-treated in the at least one sliding section to minimize surface roughness.

7. The key tappet of claim 1, wherein the guiding section is formed of a friction-minimizing plastic material or of a plastic material with a friction-minimizing additive.

8. The key tappet of claim 2, wherein the guiding section is formed of a friction-minimizing plastic material or of a plastic material with a friction-minimizing additive.

9. The key module of claim 4, wherein the guiding section is surface-treated in the at least one sliding section to minimize surface roughness.

10. The key module of claim 4, wherein the guiding section is formed of a friction-minimizing plastic material or of a plastic material with a friction-minimizing additive.

* * * * *